United States Patent [19]

Koshiishi et al.

[11] 4,290,829

[45] Sep. 22, 1981

[54] PROCESS FOR BOX ANNEALING A STEEL STRIP COIL

[75] Inventors: Hiromichi Koshiishi; Kunio Mori; Hiroshi Sato; Akira Sakaida, all of Kitakyushu, Japan

[73] Assignee: Nippon Steel Corporation, Tokyo, Japan

[21] Appl. No.: 153,673

[22] Filed: May 27, 1980

[30] Foreign Application Priority Data

May 24, 1979 [JP] Japan ..... 54-64463

[51] Int. Cl.[3] ..... C21D 9/52

[52] U.S. Cl. ..... 148/130; 148/112; 148/113; 148/131

[58] Field of Search ..... 148/130, 131, 112, 113, 148/121, 122, 16, 16.7

[56] References Cited

U.S. PATENT DOCUMENTS 2,769,630 11/1956 Keller ..... 148/131

*Primary Examiner*—R. Dean

*Attorney, Agent, or Firm*—Wenderoth, Lind & Ponack

[57] ABSTRACT

A box annealed steel strip having small strains is produced by: pretreating a steel strip in such a manner that a side edge portion thereof is thermally treated under a different condition from another condition under which the remaining portion, including an opposite side edge, thereof is thermally treated, so as to cause the longitudinal length of the side edge portion to be different from that of the remaining portion; winding the pretreated steel strip under tension to form a coil in such a manner that greater tensile stresses are produced in the other one of the side edge portion and the remaining portion, which one has a longitudinal length smaller than that of the other one, than those produced in the other one; placing the coil on a base plate so that a side edge included in the portion having the greater stresses comes into contact with the base plate, and; box annealing the coil on the base plate in a box annealing furnace.

10 Claims, 5 Drawing Figures

PROCESS FOR BOX ANNEALING A STEEL STRIP COIL

FIELD OF THE INVENTION

The present invention relates to a process for box annealing a steel strip coil. More particularly, the present invention relates to a process for box annealing a steel strip coil while decreasing creation of strain in a side edge portion of the steel strip kept in contact with a base plate during the box annealing procedure.

BACKGROUND OF THE INVENTION

Generally, a cold rolled steel strip is subjected to an annealing process in order to relieve strains generated thereon during the cold rolling process. In the case where the cold rolled steel strip is an electric steel strip containing 2 to 4% by weight of silicon, after the electric steel strip is formed into desired final dimensions by the cold rolling, an annealing is applied to the cold rolled electric steel strip for the purpose of adjusting the composition of the steel strip by means of, for example, decarburization and denitrification, or controlling the crystallization of the steel strip.

Generally, the annealing is carried out in a continuous annealing procedure, a box annealing procedure or a combination of the above-mentioned procedures.

In the case where the annealing process includes a box annealing procedure, a plurality of steel strips are individually wound around a winding core to provide a plurality of coils and each coil is placed on a base plate. A plurality of combinations, each consisting of a coil and a base plate, are piled up in a box annealing furnace in such a manner that the longitudinal axis of the winding core in each coil is vertical and, then, a box annealing procedure is applied to the coils.

In the steel strip coil which has been box annealed by the above-mentioned procedures, strains are produced in the side edge portion of the steel strip which has been kept in contact with the base plate during the box annealing procedure and the side edge portion is deformed. When the box annealed steel strip is an electric steel strip and the electric steel strip is used in a laminated state, for example, in the production of a transformer or a motor core, the strains produced in the side edge portion of the steel strip cause serious disadvantages. In the case where the box annealed steel strip is an ordinary cold rolled steel strip, the strains can be released by a temper rolling applied to the box annealed steel strip. However, the larger the strains in the box annealed steel strip, the more difficult to release the strains by means of the temper rolling. Therefore, even in the case of the ordinary cold rolled steel strip, it is desirable that the strains created in the box annealed steel strip be as small as possible. Especially, in the case of a cold rolled steel strip, particularly, an electric steel strip, to which a finishing operation, for example, a temper rolling operation, is not applied, the side edge portion of the steel strip in which the strains have been produced, is cut off. When no cutting off operation is applied to the side edge portion of the steel strip having the strains, it is necessary to apply a reforming procedure to the steel strip. However, the reforming procedure causes the magnetic flux density and other electromagnetic properties of the steel strip to be undesirably deteriorated. Therefore, it is desirable that the production of the strains in the steel strip during the box annealing procedure be prevented as much as possible.

It is known that, in order to decrease the production of the strains in the steel strip during the box annealing procedure, the following approaches have been attempted.

(1) A side edge portion of a steel strip is notched, the steel strip is formed into a coil and placed on a base plate in such a manner that the notched side edge portion is brought into contact with the base plate, and then, the steel strip coil on the base plate is placed in the box annealing furnace and box annealed therein.

(2) A steel strip is formed into a coil in such a manner that the side edges of the resultant coil become uneven, the steel strip coil is placed on a base plate in such a manner that an uneven side edge of the coil is brought into contact with the base plate and, then, the coil on the base plate is subjected to a box annealing procedure.

However, the above-mentioned approaches have failed to satisfactorily decrease the creation of strains in the side edge portion of the steel strip. Therefore, the above-mentioned approaches have not yet been practically utilized in industry.

In addition to the above-mentioned approaches, the following approaches have been attempted.

A. When a steel strip is wound to form a coil, an extremely large tension is evenly applied to the entire body of the steel strip. The coil is subjected to a box annealing procedure.

B. When it has been damaged during a winding procedure applied to a steel strip prior to the box annealing procedure that a side edge portion of the steel strip has been stretched so as to produce larger stresses therein than those in the other side edge portion of the steel strip, the resultant steel strip coil is placed on a base plate so that the side edge of the steel strip, which has been deemed to have larger stresses than that of the other side edge, is brought into contact with the base plate, and then, the coil on the base plate is subjected to a box annealing procedure.

The approach A is effective for reducing the production of strains in the side edge portion of the steel strip kept in contact with the base plate. However, the approach A is disadvantageous that sometimes undesirable thermal strains are produced in the middle portion of the steel strip, or during the box annealing procedure, the flow of the atmospheric gas in the box annealing furnace into the inside of the coil becomes unsatisfactory, and this unsatisfactory flow causes the adjustment of the composition of the steel strip and the chemical reactions on the surface of the steel strip, which are the purposes of the box annealing procedure, to become unsatisfactory.

In the case of the approach B, it is difficult to discover the side edge having a larger stress than that of the other side edge of the steel strip because the difference in stress is frequently produced due to unexpected causes. Accordingly, the method of the approach B is not always utilizable for the steel strip coil.

SUMMARY OF THE INVENTION

An object of the present invention is to provide a process for box annealing a steel strip coil, which is capable of significantly decreasing the production of strains in a side edge portion of the steel strip during the box annealing procedure, without deteriorating the quality of the resultant box annealed steel strip.

Another object of the present invention is to provide a process for box annealing a steel strip coil, which is effective for protecting a side edge portion of the steel strip kept in contact with a base plate during the box annealing procedure from creation of strains therein, in a simple manner.

The above-mentioned objects can be attained by the process of the present invention, which comprises the steps of:

pretreating a steel strip in such a manner that a side edge portion of said steel strip is subjected to a thermal treatment different from another thermal treatment to which the remaining portion, including an opposite side edge, of the steel strip is subjected, the difference between the thermal treatments applied to the side edge portion and the remaining portion causing the longitudinal length of the side edge portion to become different from that of the remaining portion of the steel strip;

winding the pretreated steel strip under tension to form a coil in such a manner that greater tensile stresses are created in either one of said side edge portion and said remaining portion, which one has a longitudinal length smaller than that of the other one, than those produced in the other one;

placing said coil on a base plate in such a manner that a side edge included in said portion having the greater stresses, of said steel strip, is brought into contact with said base plate, and;

box annealing said coil on said base plate in a box annealing furnace.

BRIEF EXPLANATION OF THE INVENTION

Figure 4:
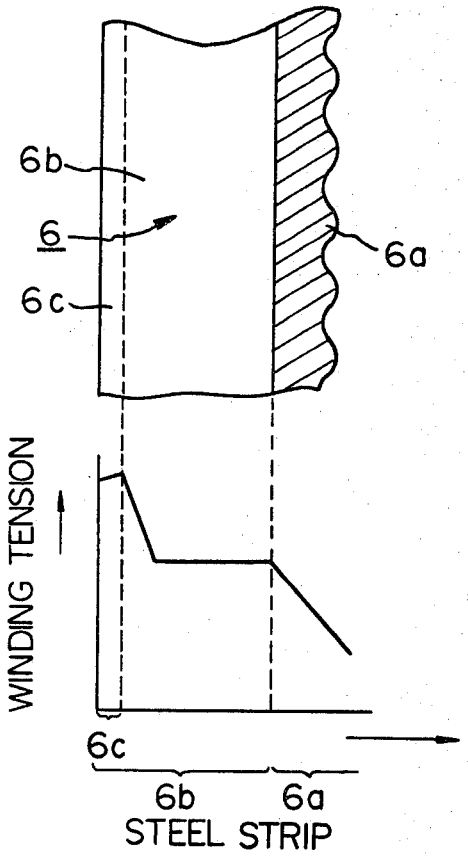
Figure 5:
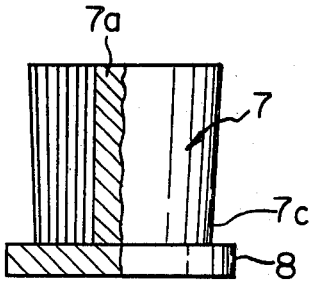

FIG. 4 indicates a distribution of winding tension applied to a pretreated steel strip, and;

FIG. 5 is a partial cross-sectional view of a steel strip coil placed on a base plate in accordance with the process of the present invention.

DETAILED DESCRIPTION OF THE INVENTION

In the process of the present invention, a steel strip to be box annealed is pretreated in such a manner that a side edge portion of the steel strip is thermally treated under a different condition from another condition which is applied to the remaining portion, including an opposite side edge, of the steel strip. The difference in the thermal treating condition between the side edge portion and the remaining portion of the steel strip causes the longitudinal length of the side edge portion to become longer or shorter than that of the remaining portion.

The pretreatment can be carried out by uniformly heating the steel strip to a predetermined temperature and, then, cooling the steel strip, in one stage during the cooling operation, the side edge portion being additionally cooled to a temperature lower than that of the remaining portion of the steel strip. This pretreatment is followed by a winding operation, which is carried out in such a manner that greater stresses are created in the remaining portion than those produced in the side edge portion, and a placing operation, which is carried out in such a manner that the opposite side edge included in the remaining portion is brought into contact with the base plate.

The pretreatment may be carried out in such a manner that the steel strip is uniformly heated for the decarburization thereof to a temperature (T) of from 750° to 900° C., for example, in a continuous annealing furface, and the side edge portion of the steel strip is rapidly cooled from a temperature ($T_1$) of from 600° to 800° C. to a temperature ($T_{2a}$) of from 450° to 650° C. while the remaining portion of the steel strip is cooled to a temperature ($T_{2b}$) which is at least 50° C. above the temperature ($T_{2a}$) of the additionally cooled side edge portion. It is preferable that the difference in temperature ($T_{2b}-T_{2a}$) between the cooled side edge portion and the cooled remaining portion be in a range of from 50° to 150° C.

During the above-mentioned pretreatment, the difference in temperature between the side edge portion and the remaining portion of the steel strip results in production of a difference between thermal tensile stresses created in the side edge portion and the remaining portion of the steel strip. That is, the thermal tensile stress created in the side edge portion becomes larger than that created in the remaining portion of the steel strip. This phenomenon causes the side edge portion to be plastically deformed, so that the longitudinal length of the side edge portion becomes larger than that of the remaining portion of the steel strip.

After the above-mentioned cooling pretreatment, the steel strip may be additionally cooled to a desired temperature ($T_3$) at which a next procedure, for example, a winding operation, is carried out, for example, a room temperature. In the additional cooling, the plastic deformation of the side edge portion of the steel strip is maintained.

As a result of the pretreatment, the longitudinal length of the side edge portion of the steel strip becomes 0.1 to 0.7% above the longitudinal length of the remaining portion of the steel strip.

It is preferable that the side edge portion of the steel strip have a width corresponding to 5 to 20% of the entire width of the steel strip.

The pretreated steel strip is wound around a winding core to form a coil. This winding operation is carried out under a tension, so that greater stresses are produced in the remaining portion than those produced in the side edge portion of the steel strip. This winding procedure is effective for enhancing the rigidity of the remaining portion including the opposite side edge. The resultant coil is placed on a base plate in such a manner that the opposite side edge included in the remaining portion of the steel strip is brought into contact with the base plate. That is, the winding core in the coil positions at a right angle to the upper surface of the base plate.

The coil on the base plate is placed in a box annealing furnace and box annealed therein. The box annealing procedure is preferably carried out at a temperature of from 900° to 1250° C. for 0.5 to 40 hours. During the box annealing procedure, the opposite side edge portion of the steel strip is stressed with a compressive load in the vertical direction by the weight of the coil itself and a frictional load in the horizontal direction between the coil and the base plate. However, since the opposite edge portion kept in contact with the base plate has an increased rigidity, only decreased strains are produced in the opposite edge portion of the steel strip during the box annealing procedure.

The process of the present invention will now be explained with reference to the accompanying drawings.

Figure 1:
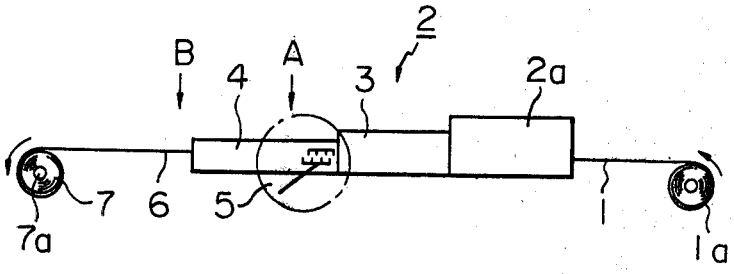
FIG. 1 is an explanatory illustration used for explaining an example of procedure for pretreating and winding a steel strip in accordance with the process of the present invention.
Figure 2:
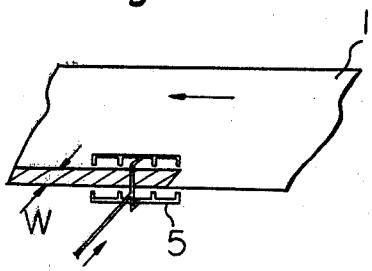
FIG. 2 is an explanatory illustration used for exaplaining the procedure for pretreating a steel strip in the cooling zone A indicated in FIG. 1.

Referring to FIG. 1, a pretreatment is applied to a steel strip 1, which has not yet been box annealed, in a continuous annealing apparatus. The steel strip 1 is withdrawn from a coil 1 and fed into a continuous annealing apparatus 2. In a heating zone 2*a* in the apparatus 2, the steel strip is heated to a desired temperature, and in a soaking zone 3, the temperature of the steel strip is maintained constant at a desired level. Thereafter, the steel strip 1 is fed into a cooling zone 4 containing a local cooling device 5 for selectively, rapidly cooling a side edge portion of the steel strip 1. In the cooling zone 4, a cooling gas having a desired temperature, for instance, room temperature, is blown toward the upper and lower surfaces of the side edge portion of the steel strip through the local cooling device 5, so as to rapidly cool the side edge portion to a temperature lower than that of the remaining portion of the steel strip. Referring to FIGS. 1 and 2, the width (W) of the side edge portion to be rapidly cooled can be optionally adjusted as required. The rapid cooling of the side edge portion produces a difference in temperature between the side edge portion and the remaining portion of the steel strip. That is, just after the steel strip 1 has passed through the local cooling device 5, the temperature of the rapidly cooled side edge portion is lower than that of the remaining portion of the steel strip. Accordingly, the rapidly cooled side edge portion will shrink to an extent corresponding to the cooling temperature thereof. However, the remaining portion of the steel strip having a higher temperature than that of the side edge portion is in an expanded condition in relation to the side edge portion. Therefore, the shrinkage of the side edge portion is hindered by the remaining portion and a tensile stress is created in the side edge portion. When this tensile stress is greater than a stress corresponding to a yield point of the steel strip at the temperature of the side edge portion at which the tensile stress is created, a plastic deformation is caused in the side edge portion due to the tensile stress. That is, the longitudinal length of the side edge portion becomes larger than that of the remaining portion of the steel strip.

Thereafter, the steel strip is additionally cooled, as a whole, to a desired temperature, for example, room temperature. The thus pretreated steel strip 6 is delivered from the cooling zone 4. Even after the additional cooling in the cooling zone 4, the longitudinal length of the side edge portion is still greater than that of the remaining portion of the steel strip. Accordingly, as illustrated in FIG. 3, the side edge portion 6*a* having a larger longitudinal length than that of the remaining portion 6*b* is slightly corrugated.

Figure 3:
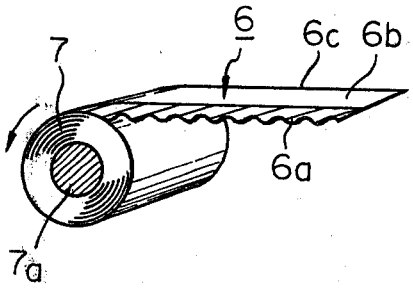
FIG. 3 is an explanatory illustration used for explaining the procedure for winding a pretreated steel strip.

Referring to FIGS. 1 and 3, the pretreated steel strip 6 is wound around a winding core 7*a*, under tension, to form a coil 7. In this winding procedure, the remaining portion 6*b* is wound under a larger tension than that of the side edge portion 6*a* and, therefore, greater tensile stresses are created in the remaining portion 6*b* than those produced in the side edge portion 6*a* of the steel strip 6. It is especially important that the opposite side edge portion 6*c* be wound under an extremely large tension and, therefore, extremely large tensile strains are produced in the opposite side edge 6*c* of the steel strip 6. This feature is clearly illustrated in FIG. 4. That is referring to FIG. 4, the winding procedure is carried out while applying an extremely large tension to the opposite side end portion 6*c*, a small tension to the side edge portion 6*a* and a moderate tension to a middle portion between the side edge portion 6*a* and the opposite side edge portion 6*c*. The above-mentioned feature of the winding procedure, causes the rigidity of the opposite side edge portion 6*c* to be significantly enhanced.

Referring to FIGS. 3 and 5, the coil 7 is placed on a base plate 8 so that the winding core 7*a* is positioned at a right angle to the upper surface of the base plate 8 and a side end 7*c* of the coil 7, consisting of the opposite side edge portion 6*c* of the steel strip 6, is brought into contact with the base plate 8. In the coil 7, the diameter of the upper portion 7*a*, consisting of the side edge portion 6*a* of the steel strip 6, is larger than that of the lower end portion 7*c*.

This feature is effective for promoting the flow of a heating medium into the inside of the coil. As a result of the flow, the coil can be uniformly box annealed.

The coil of the steel strip on the base plate is placed in a box annealing furnace and box annealed therein. During the box annealing procedure, the coil on the base plate is repeatedly heated and cooled in accordance with a predetermined box annealing program. Therefore, the coil and the base plate are repeatedly expanded and shrunk. However, the expansion and shrinkage of the coil is usually not exactly the same as those of the base plate.

These differences in expansion and shrinkage between the coil and the base plate produce a horizontal friction between the lower end surface of the coil and the upper surface of the base plate. Therefore, the lower end portion of the coil kept in contact with the base plate is stressed, not only by a vertical load due to the weight of the coil itself, but also, by a horizontal load due to the above-mentioned friction. This phenomenon causes large strains to be produced in the side end portion of the coil kept in contact with the base plate. However, since the side end portion of the coil prepared in accordance with the process of the present invention has an enhanced rigidity, the strains produced in the side end portion of the coil are very small.

In the process of the present invention, the pretreatment can be carried out by uniformly heating the steel strip to a predetermined temperature and, then, cooling the steel strip, in one stage during the cooling operation, the temperature of the side edge portion being maintained higher than that of the remaining portion by localling heating the side edge portion of the steel strip. This pretreatment is followed by a winding operation which is carried out in such a manner that greater stresses are created in the side edge portion than those produced in the remaining portion and a placing operation which is carried out in such a manner that a side edge included in the side edge portion is brought into contact with the bare plate.

In the above-mentioned pretreatment, the steel strip may be uniformly heated to a temperature of from 750° to 900° C., and in one stage of the cooling operation, the temperature of the side edge portion is maintained at least 50° C. above that of the remaining portion of the steel strip. The pretreatment results in a longitudinal length of the side edge portion which is from 0.1 to 0.7% smaller than that of the remaining portion of the steel strip.

The local heating of the side edge portion of the steel strip can be effected by any conventional heating methods, for example, burner flame heating, radiant tube heating or high temperature gas-heating methods.

According to the process of the present invention, it is possible to minimize the production of strains in the side end portion of the coil kept in contact with the base plate, without deteriorating the quality of the steel strip.

The process of the present invention has been illustrated above with reference to the embodiment in which a steel strip coil is placed on a base plate. However, one or more steel strip coils may be piled up on another coil placed on a base plate.

Also, the pretreatment in the process of the present invention may be applied to the steel strip in any continuous thermal procedures prior to the box annealing procedure. For example, the pretreatment may be carried out in a continuous annealing procedure or continuous decarburization annealing procedure.

When a conventional box annealing process is applied to a steel strip, usually it is found that large strains are produced in its opposite side edge portion having a width of 35 to 60 mm, which has been kept in contact with the base plate during the box annealing procedure. Therefore, the opposite side edge portion having strains are cut off from the remaining portion of the steel strip. This results in a poor yield of the product.

However, in the box annealing process of the present invention, small strains are produced in the opposite side edge portion having a small width of about 10 to 20 mm. Therefore, only the small width of 10 to 20 mm of the opposite side edge portion of the steel strip is cut off. Consequently, the yield of the product in the process of the present invention is significantly higher than that in the conventional process. Especially, when the process of the present invention is applied to an electric steel strip, for example, grain-oriented electric steel strip, the product can be obtained with a remarkably increased yield over that of the conventional process.

Also, when the process of the present invention is utilized, it is not necessary to subject the resultant box annealed steel strip to any reforming procedures including a temper rolling procedure. Even if the temper rolling procedure is applied by, for example, users, to the box annealed steel strip obtained from the process of the present invention, the temper rolling procedure does not cause the quality of the steel strip to be deteriorated.

The specific examples presented below will serve to more fully clarify how the present invention is practiced. However, it will be understood that these examples are only illustrative and in no way limit the present invention.

EXAMPLE 1

A cold oriented, grain oriented electric steel strip having a thickness of 0.3 mm and a width of 950 mm, was fed into a continuous decarburization annealing furnace having a heating zone, soaking zone and cooling zone. A local cooling device was located in the upstream portion of the cooling zone. The steel strip was heated to 800° C. in the heating zone, this temperature of the steel strip was maintained constant in the soaking zone. When the soaked steel strip was fed into the cooling zone and reached a temperature of 700° C., a side edge portion having a width of about 100 mm was rapidly cooled to 570° C. by blowing cooling hydrogen, nitrogen or AX gas thereto through the local cooling device. When the side edge portion of the steel strip reached a temperature of 570° C., the remaining portion of the steel strip reached 620° C. Thereafter, the steel strip, as a whole, was additionally cooled to 250° C. in the downstream portion of the cooling zone.

When the steel strip was delivered from the cooling zone, its side edge portion had a longitudinal length of 3 m longer than 1000 m of the corresponding remaining portion of the steel strip.

The pretreated steel strip having a length of 2500 m was wound around a winding core under tension to form a coil. The coil is placed on a base plate in such a manner that the opposite side end of the steel strip was brought into contact with the base plate. The coil on the base plate was box annealed at a temperature of 1150° C., for 30 hours, in a box annealing furnace.

The width of the opposite edge portion of the steel strip in which strains were produced, was in a range of from 10 to 20 mm. This width is very small.

We claim:

1. A process for box annealing a steel strip coil, comprising the steps of:

pretreating a steel strip in such a manner that a side edge portion of said steel strip is subjected to a thermal treatment different from another thermal treatment to which the remaining portion, including an opposite side edge, of said steel strip is subjected, the difference between the thermal treatments applied to said side edge portion and said remaining portion causing the longitudinal length of said edge portion to become different from that of said remaining portion of said steel strip;

winding said pretreated steel strip under tension to form a coil in such a manner that greater tensile stresses are created in either one of said side edge portion and said remaining portion, which one has a longitudinal length smaller than that of the other one, than those produced in the other one;

placing said coil on a base plate in such a manner that a side edge included in said portion having the greater stresses, of said steel strip, is brought into contact with said base plate, and;

box annealing said coil on said base plate in a box annealing furnace.

2. A process as claimed in claim 1, wherein said pretreatment is carried out by uniformly heating said steel strip to a predetermined temperature and, then, cooling said steel strip, in one stage during said cooling operation, said side edge portion being additionally cooled to a temperature lower than that of said remaining portion:

said winding operation is carried out in such a manner that greater stresses are created in said remaining portion than those produced in said side edge portion, and;

said placing operation is carried out in such a manner that said opposite side edge included in said remaining portion is brought into contact with said base plate.

3. A process as claimed in claim 2, wherein said pretreatment is carried out in such a manner that said steel strip is uniformly heated to a temperature of from 750° to 900° C., and in one stage of said cooling operation said side edge portion of said steel strip is rapidly cooled to a temperature of from 600° to 800° C., while said remaining portion is cooled to a temperature which is at least 50° C. above the temperature of said cooled side edge portion.

4. A process as claimed in claim 1, wherein said pretreatment is carried out by uniformly heating said steel strip to a predetermined temperature and, then, cooling said steel strip, in one stage during said cooling operation, the temperature of said side edge portion being maintained higher than that of said remaining portion by locally heating said side edge portion;

said winding operation is carried out in such a manner that greater stresses are created in said side edge portion than those produced in said remaining portion, and;

said placing operation is carried out in such a manner that a side edge included in said side edge portion is brought into contact with said base plate.

5. A process as claimed in claim 4, wherein said pretreatment, said steel strip is uniformly heated to a temperature of from 750° to 900° C., and, in one stage of said cooling operation, the temperature of said side edge portion is maintained at least 50° C. above that of said remaining portion.

6. A process as claimed in claim 3 or 5, wherein the difference in temperature between said side edge portion and remaining portion of said steel strip is in a range of from 50° to 150° C.

7. A process as claimed in claim 2, wherein said pretreatment results in a longitudinal length of said side edge portion which is from 0.1 to 0.7% greater than that of said remaining portion of said steel strip.

8. A process as claimed in claim 4, wherein said pretreatment results in a longitudinal length of said side edge portion which is from 0.1 to 0.7% smaller than that of said remaining portion of said steel strip.

9. A process as claimed in claim 1, wherein said side edge portion of said steel strip has a width corresponding to 5 to 20% of the entire width of said steel strip.

10. A process as claimed in claim 1, wherein said box annealing operation is carried out at a temperature of from 900° to 1250° C. for 0.5 to 40 hours.

* * * * *